US012624497B2

(12) United States Patent
Kim et al.

(10) Patent No.: US 12,624,497 B2
(45) Date of Patent: May 12, 2026

(54) DRYER AND METHOD OF CONTROLLING THE SAME

(71) Applicant: Samsung Electronics Co., Ltd., Suwon-si (KR)

(72) Inventors: Taehyung Kim, Suwon-si (KR); Eunkyeong Kwak, Suwon-si (KR); Minhwan Oh, Suwon-si (KR); Hooijoong Kim, Suwon-si (KR); Hyemin Cha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 683 days.

(21) Appl. No.: 18/183,600

(22) Filed: Mar. 14, 2023

(65) Prior Publication Data

US 2023/0399792 A1 Dec. 14, 2023

Related U.S. Application Data

(63) Continuation of application No. PCT/KR2023/003281, filed on Mar. 10, 2023.

(30) Foreign Application Priority Data

Jun. 10, 2022 (KR) ..... 10-2022-0070949

(51) Int. Cl.
*D06F 58/02* (2006.01)
*D06F 34/18* (2020.01)
(Continued)

(52) U.S. Cl.
CPC ..... *D06F 58/52* (2020.02); *D06F 34/18* (2020.02); *D06F 34/20* (2020.02); *D06F 34/28* (2020.02);
(Continued)

(58) Field of Classification Search
CPC ..... D06F 58/02; D06F 58/04; D06F 58/30; D06F 58/32; D06F 58/36; D06F 58/52; D06F 58/50
(Continued)

(56) References Cited

U.S. PATENT DOCUMENTS 5,887,456 A * 3/1999 Tanigawa ..... D06F 35/006 68/18 C
10,731,289 B2 8/2020 Kim et al.
(Continued)

FOREIGN PATENT DOCUMENTS

CN 110004679 A 7/2019
CN 112481976 A 3/2021
(Continued)

OTHER PUBLICATIONS

Extended European Search Report dated Mar. 28, 2025, issued in a European Patent Application No. 23819959.0.
(Continued)

*Primary Examiner* — Deming Wan
(74) *Attorney, Agent, or Firm* — Jefferson IP Law, LLP

(57) ABSTRACT

A dryer is provided. The dryer includes a cabinet, a drum rotatably disposed inside the cabinet, at least one roller mounted on at least one surface inside of the cabinet to support the drum, a motor configured to provide power to rotate the drum, a motor driver configured to control the motor, and at least one processor configured to determine at least one of a first rotation velocity of the motor or a first rotation time of the motor based on a non-use time of the dryer, and control the motor driver based on the determined at least one of the first rotation velocity or the first rotation time of the motor.

22 Claims, 16 Drawing Sheets

(51) Int. Cl.

| | |
|---|---|
| ***D06F 34/20*** | (2020.01) |
| ***D06F 34/28*** | (2020.01) |
| ***D06F 58/04*** | (2006.01) |
| ***D06F 58/06*** | (2006.01) |
| ***D06F 58/08*** | (2006.01) |
| ***D06F 58/30*** | (2020.01) |
| ***D06F 58/32*** | (2020.01) |
| ***D06F 58/36*** | (2020.01) |
| ***D06F 58/38*** | (2020.01) |
| ***D06F 58/50*** | (2020.01) |
| ***D06F 58/52*** | (2020.01) |
| *D06F 101/20* | (2020.01) |
| *D06F 103/04* | (2020.01) |
| *D06F 103/24* | (2020.01) |
| *D06F 103/26* | (2020.01) |
| *D06F 103/38* | (2020.01) |
| *D06F 105/46* | (2020.01) |
| *D06F 105/52* | (2020.01) |

(52) U.S. Cl.
CPC ..... *D06F 58/06* (2013.01); *D06F 58/08* (2013.01); *D06F 58/38* (2020.02); *D06F 2101/20* (2020.02); *D06F 2103/04* (2020.02); *D06F 2103/24* (2020.02); *D06F 2103/26* (2020.02); *D06F 2103/38* (2020.02); *D06F 2105/46* (2020.02); *D06F 2105/52* (2020.02)

(58) Field of Classification Search
USPC ..... 34/318, 319
See application file for complete search history.

(56) References Cited

U.S. PATENT DOCUMENTS

| | | | | |
|---|---|---|---|---|
| 10,947,661 | B2 | 3/2021 | Je et al. | |
| 2005/0102853 | A1* | 5/2005 | Wang | D06F 37/06 34/318 |
| 2007/0220683 | A1 | 9/2007 | Kim | |
| 2009/0172967 | A1* | 7/2009 | Son | D06F 58/44 34/68 |
| 2022/0074114 | A1 | 3/2022 | Kim et al. | |

FOREIGN PATENT DOCUMENTS

| | | | |
|---|---|---|---|
| EP | 3124689 | A1 | 2/2017 |
| JP | H11-276757 | A | 10/1999 |
| JP | 2000-237491 | A | 9/2000 |
| JP | 4674601 | B2 | 4/2011 |
| JP | 2020-199010 | A | 12/2020 |
| KR | 10-0640846 | B1 | 11/2006 |
| KR | 10-0692582 | B1 | 3/2007 |
| KR | 10-2007-0039746 | A | 4/2007 |
| KR | 10-0856305 | B1 | 9/2008 |
| KR | 10-2010-0104817 | A | 9/2010 |
| KR | 10-2014-0094434 | A | 7/2014 |
| KR | 10-2019-0011793 | A | 2/2019 |
| KR | 10-2019-0046599 | A | 5/2019 |
| KR | 10-2019-0057659 | A | 5/2019 |
| KR | 10-2019-0057682 | A | 5/2019 |
| KR | 10-2021-0090415 | A | 7/2021 |
| KR | 10-2022-0033684 | A | 3/2022 |
| WO | 2009/061325 | A1 | 5/2009 |

OTHER PUBLICATIONS

International Search Report dated Jul. 3, 2023, issued in International Patent Application No. PCT/KR2023/003281.

* cited by examiner

FIG. 5

| AMOUNT OF PRESSING ON RUBBER OF ROLLER ACCORDING TO AMBIENT TEMPERATURE AND NON-USE TIME(mm) | | | | | | | | | | | | | | | | | | | | | |
|---|---|---|---|---|---|---|---|---|---|---|---|---|---|---|---|---|---|---|---|---|---|
| NON-USE TIME(hr) | 0 | 1 | 2 | 3 | 4 | 5 | 6 | 7 | 8 | 9 | 10 | 11 | 12 | 13 | 14 | 15 | 16 | 17 | 18 | 19 | 20 |
| 40℃ | 0 | 0.4 | 0.7 | 0.9 | 1.1 | 1.1 | 1.2 | 1.3 | 1.3 | 1.4 | 1.4 | 1.5 | 1.5 | 1.5 | 1.4 | 1.5 | 1.5 | 1.5 | 1.5 | 1.6 | 1.5 |
| 30℃ | 0 | 0.4 | 0.7 | 0.8 | 1 | 1.1 | 1.1 | 1.2 | 1.3 | 1.4 | 1.4 | 1.4 | 1.5 | 1.4 | 1.5 | 1.5 | 1.5 | 1.6 | 1.5 | 1.5 | 1.5 |
| 20℃ | 0 | 0.4 | 0.6 | 0.9 | 0.9 | 1 | 1.1 | 1.2 | 1.2 | 1.3 | 1.4 | 1.4 | 1.5 | 1.4 | 1.5 | 1.5 | 1.4 | 1.5 | 1.5 | 1.4 | 1.5 |
| 10℃ | 0 | 0.3 | 0.6 | 0.8 | 0.9 | 1 | 1.1 | 1.2 | 1.2 | 1.3 | 1.3 | 1.4 | 1.4 | 1.4 | 1.4 | 1.4 | 1.5 | 1.4 | 1.4 | 1.4 | 1.4 |
| 0℃ | 0 | 0.3 | 0.6 | 0.7 | 0.8 | 0.9 | 1 | 1.1 | 1.1 | 1.2 | 1.2 | 1.3 | 1.3 | 1.4 | 1.3 | 1.3 | 1.3 | 1.3 | 1.4 | 1.3 | 1.3 |
| -10℃ | 0 | 0.3 | 0.5 | 0.7 | 0.8 | 0.9 | 0.9 | 1 | 1.1 | 1.1 | 1.1 | 1.2 | 1.2 | 1.2 | 1.2 | 1.2 | 1.2 | 1.3 | 1.2 | 1.3 | 1.2 |

FIG. 8

| MOTOR RPM | DRUM RPM | PULLEY RATIO |
|---|---|---|
| 400 | 8.8 | 45.2 |
| 800 | 17.7 | |
| 1200 | 26.5 | |

FIG. 9

| ROTATIONAL INITIAL NOISE PREVENTION CONDITIONS ACCORDING TO AMOUNT OF PRESSING ON ROLLER (MAXIMUM RPM OF MOTOR) | | | | | | | | | | | | | | | | | |
|---|---|---|---|---|---|---|---|---|---|---|---|---|---|---|---|---|---|
| AMOUNT OF PRESSING ON ROLLER (mm) | | 0 | 0.1 | 0.2 | 0.3 | 0.4 | 0.5 | 0.6 | 0.7 | 0.8 | 0.9 | 1 | 1.1 | 1.2 | 1.3 | 1.4 | 1.5 |
| ROTATION VELOCITY OF MOTOR (RPM) | SET1 | X | X | X | 1400 | 1350 | 1300 | 1250 | 1250 | 1150 | 1100 | 1050 | 1050 | 950 | 900 | 850 | 800 |
| | SET2 | X | X | 1500 | 1450 | 1400 | 1400 | 1350 | 1300 | 1200 | 1200 | 1150 | 1100 | 1050 | 950 | 900 | 850 |
| | SET3 | X | X | 1550 | 1450 | 1300 | 1350 | 1250 | 1250 | 1200 | 1150 | 1150 | 1050 | 1000 | 900 | 900 | 850 |
| | SET4 | X | X | X | 1400 | 1350 | 1350 | 1300 | 1300 | 1250 | 1200 | 1150 | 1150 | 1100 | 1000 | 950 | 850 |
| | SET5 | X | X | 1450 | 1400 | 1350 | 1350 | 1300 | 1250 | 1200 | 1100 | 1050 | 1050 | 1000 | 950 | 900 | 850 |
| | Max | X | X | 1550 | 1450 | 1400 | 1400 | 1350 | 1300 | 1250 | 1200 | 1150 | 1150 | 1100 | 1000 | 950 | 850 |

FIG. 10

| ROTATIONAL INITIAL NOISE PREVENTION CONDITIONS ACCORDING TO AMOUNT OF PRESSING ON ROLLER FOR EACH RPM (TIME(s)) | | | | | |
|---|---|---|---|---|---|
| AMOUNT OF PRESSING ON ROLLER(mm) | | 0.4 | 0.8 | 1.2 | 1.6 |
| 1600rpm | SET1 | 32 | 54 | 71 | 82 |
| | SET2 | 30 | 52 | 69 | 85 |
| 2000rpm | SET1 | 24 | 44 | 56 | 64 |
| | SET2 | 23 | 41 | 54 | 67 |
| 24000rpm | SET1 | 21 | 35 | 48 | 57 |
| | SET2 | 20 | 36 | 48 | 56 |

FIG. 11

| ROTATIONAL INITIAL NOISE PREVENTION CONDITIONS ACCORDING TO AMOUNT OF PRESSING ON ROLLER FOR EACH RPM (NUMBER OF ROTATIONS OF DRUM) | | | | | |
|---|---|---|---|---|---|
| AMOUNT OF PRESSING ON ROLLER(mm) | | 0.4 | 0.8 | 1.2 | 1.6 |
| 1600rpm | SET1 | 19 | 32 | 42 | 48 |
| | SET2 | 17 | 31 | 41 | 50 |
| 2000rpm | SET1 | 18 | 32 | 42 | 47 |
| | SET2 | 17 | 31 | 40 | 49 |
| 24000rpm | SET1 | 19 | 31 | 42 | 50 |
| | SET2 | 18 | 32 | 42 | 50 |
| AVG | - | 18 | 31 | 41 | 49 |

FIG. 13

| OPTIMAL MOTOR RPM ACCORDING TO INDOOR TEMPERATURE AND NON-USE TIME | | | | | | | | | | | | |
|---|---|---|---|---|---|---|---|---|---|---|---|---|
| INDOOR TEMPERATURE | 0~1H | 1~2H | 2~3H | 3~4H | 4~5H | 5~6H | 6~7H | 7~8H | 8~9H | 9~10H | 10~11H | 11~12H OR LONGER |
| 40℃ OR ABOVE | 1400 | 1300 | 1200 | 1150 | 1150 | 1100 | 1000 | 1000 | 950 | 950 | 850 | 850 |
| 20℃~30℃ | 1400 | 1300 | 1250 | 1150 | 1150 | 1150 | 1100 | 1000 | 950 | 950 | 950 | 850 |
| 10℃~20℃ | 1400 | 1350 | 1200 | 1200 | 1150 | 1150 | 1100 | 1100 | 1000 | 950 | 950 | 850 |
| 0℃~10℃ | 1450 | 1350 | 1250 | 1200 | 1150 | 1150 | 1100 | 1100 | 1000 | 1000 | 950 | 950 |
| -10℃~0℃ | 1450 | 1350 | 1300 | 1250 | 1200 | 1150 | 1150 | 1150 | 1100 | 1100 | 1000 | 1000 |
| -10℃ OR BELOW | 1450 | 1400 | 1300 | 1250 | 1200 | 1200 | 1150 | 1150 | 1150 | 1100 | 1100 | 1100 |

FIG. 14

| OPTIMAL MOTOR OPERATION TIME ACCORDING TO INDOOR TEMPERATURE AND NON-USE TIME (s) | | | | | | | | | | | | |
|---|---|---|---|---|---|---|---|---|---|---|---|---|
| INDOOR TEMPERATURE | 0~1H | 1~2H | 2~3H | 3~4H | 4~5H | 5~6H | 6~7H | 7~8H | 8~9H | 9~10H | 10~11H | 11~12H OR LONGER |
| 40℃ OR ABOVE | 35 | 61 | 80 | 95 | 95 | 104 | 120 | 120 | 132 | 132 | 154 | 154 |
| 20℃~30℃ | 35 | 61 | 70 | 88 | 95 | 95 | 104 | 120 | 132 | 132 | 132 | 154 |
| 10℃~20℃ | 35 | 51 | 73 | 80 | 88 | 95 | 104 | 104 | 120 | 132 | 132 | 154 |
| 0℃~10℃ | 29 | 51 | 70 | 80 | 88 | 95 | 104 | 104 | 120 | 120 | 132 | 132 |
| -10℃~0℃ | 29 | 51 | 61 | 70 | 80 | 88 | 95 | 95 | 104 | 104 | 120 | 120 |
| -10℃ OR BELOW | 29 | 43 | 61 | 70 | 80 | 80 | 88 | 95 | 95 | 104 | 104 | 104 |

DRYER AND METHOD OF CONTROLLING THE SAME

CROSS-REFERENCE TO RELATED APPLICATION(S)

This application is a continuation application, claiming priority under § 365(c), of an International application No. PCT/KR2023/003281, filed on Mar. 10, 2023, which is based on and claims the benefit of a Korean patent application number 10-2022-0070949, filed on Jun. 10, 2022, in the Korean Intellectual Property Office, the disclosure of which is incorporated by reference herein in its entirety.

TECHNICAL FIELD

The disclosure relates to a dryer for reducing noise generated when a drum is rotated to dry laundry, such as clothes, and a method of controlling the same. More particularly, the disclosure relates to a dryer and a control method that are capable of determining a rotation velocity and a rotation time of a motor based on a non-use time of a dryer in order to reduce rotational initial noise of a drum.

BACKGROUND ART

A dryer is a device that dries laundry by supplying hot air into a drum containing laundry, such as clothes, towels, blankets, and the like, while rotating the drum.

The drum of the dryer is supported by at least one roller, and the at least one roller rotates together with the drum during rotation of the drum while helping the drum efficiently rotate. Therefore, the surface of the roller in contact with the drum is formed of a rubber material.

While the drum is not rotating, the weight of the drum is supported by a rear frame on which a rotary shaft of the drum is mounted and at least one roller. Accordingly, while the dryer is not in use, the at least one roller may be deformed by the weight of the drum, and the deformation of the roller may cause rotational initial noise of the drum.

The above information is presented as background information only to assist with an understanding of the disclosure. No determination has been made, and no assertion is made, as to whether any of the above might be applicable as prior art with regard to the disclosure.

DISCLOSURE

Technical Problem

Aspects of the disclosure are to address at least the above-mentioned problems and/or disadvantages and to provide at least the advantages described below. Accordingly, an aspect of the disclosure is to provide a dryer and a control method that are capable of determining a rotation velocity and a rotation time of a motor based on a non-use time of a dryer in order to reduce rotational initial noise of a drum.

Additional aspects will be set forth in part in the description which follows and, in part, will be apparent from the description, or may be learned by practice of the presented embodiments.

Technical Solution

In accordance with aspect of the disclosure, a dryer is provided. The dryer includes a cabinet, a drum rotatably disposed inside the cabinet, at least one roller mounted on at least one surface inside of the cabinet to support the drum, a motor configured to provide power to rotate the drum, a motor driver configured to control the motor, and at least one processor configured to determine at least one of a first rotation velocity of the motor or a first rotation time of the motor based on a non-use time of the dryer, and control the motor driver based on the determined at least one of the first rotation velocity or the first rotation time of the motor.

The at least one roller may, while the drum is stationary, deform due to a pressure applied from the drum, and while the drum is rotating, restore from the deformation.

The dryer may further include an input device, wherein the at least one processor may be configured to, upon receiving a user input to select a rotation cycle including a rotation of the drum, perform a noise reduction cycle for reducing noise generated by the deformation of the at least one roller, and start the rotation cycle after performing the noise reduction cycle.

The at least one processor may be configured to, in a process of performing the noise reduction, determine the at least one of the first rotation velocity of the motor or the first rotation time of the motor based on the non-use time of the dryer, and control the motor driver based on the determined at least one of the first rotation velocity or the first rotation time of the motor.

The at least one processor may be configured to determine the non-use time of the dryer based on a time gap between a time at which the rotation of the drum may be ended last, and a start time of the rotation cycle or a current time.

The at least one processor may be configured to determine a maximum revolution per minute (RPM) of the motor at which noise due to the rotation of the drum may not occur as the first rotational velocity of the motor.

The at least one processor may be configured to determine the first rotation time of the motor based on the non-use time of the dryer.

The first rotation time of the motor may be determined based on a first number of rotations of the drum and the first rotation velocity of the motor corresponding to the non-use time of the dryer.

The first number of rotations of the drum may correspond to a minimum number of rotations of the drum required to restore the deformation of the at least one roller by rotating the drum.

The at least one processor may be configured to determine the at least one of the first rotation velocity of the motor or the first rotation time of the motor based on the non-use time of the dryer and an ambient temperature.

In accordance with another aspect of the disclosure, a method of controlling a dryer including a cabinet, a drum rotatably disposed inside the cabinet, at least one roller mounted on at least one surface inside of the cabinet to support the drum, a motor configured to provide power to rotate the drum, and a motor driver configured to control the motor is provided. The method includes determining at least one of a first rotation velocity of the motor or a first rotation time of the motor based on a non-use time of the dryer, and controlling the motor driver based on the determined at least one of the first rotation velocity or the first rotation time of the motor.

The at least one roller may, while the drum is stationary, deform due to a pressure applied from the drum, and while the drum is rotating, restores from the deformation.

The method may further include upon receiving a user input to select a rotation cycle including a rotation of the drum, performing a noise reduction cycle for reducing noise generated by the deformation of the at least one roller, and starting the rotation cycle after performing the noise reduction cycle.

The performing of the noise reduction may include determining the at least one of the first rotation velocity of the motor or the first rotation time of the motor based on the non-use time of the dryer, and controlling the motor driver based on the determined at least one of the first rotation velocity or the first rotation time of the motor.

The determining of the at least one of the first rotation velocity of the motor or the first rotation time of the motor based on the non-use time of the dryer may include determining the non-use time of the dryer based on a time gap between a time at which the rotation of the drum may be ended last, and a start time of the rotation cycle or a current time.

The determining of the at least one of the first rotation velocity of the motor or the first rotation time of the motor based on the non-use time of the dryer may include determining a maximum revolution per minute (RPM) of the motor at which noise due to the rotation of the drum does not occur as the first rotational velocity of the motor.

The determining of the at least one of the first rotation velocity of the motor or the first rotation time of the motor based on the non-use time of the dryer may include determining the first rotation time of the motor based on the non-use time of the dryer.

The first rotation time of the motor may be determined based on a first number of rotations of the drum and the first rotation velocity of the motor corresponding to the non-use time of the dryer.

The first number of rotations of the drum may correspond to a minimum number of rotations of the drum required to restore the deformation of the at least one roller by rotating the drum.

The determining of the at least one of the first rotation velocity of the motor or the first rotation time of the motor based on the non-use time of the dryer may include determining the at least one of the first rotation velocity of the motor or the first rotation time of the motor based on the non-use time of the dryer and an ambient temperature.

Advantageous Effects

As is apparent from the above, a dryer according to an aspect of the disclosure and a method of controlling the same are implemented to determine a rotational velocity based on a non-use time of the dryer and perform noise reduction cycle according to the rotation velocity, thereby reducing rotational initial noise of a drum.

Other aspects, advantages, and salient features of the disclosure will become apparent to those skilled in the art from the following detailed description, which, taken in conjunction with the annexed drawings, discloses various embodiments of the disclosure.

DESCRIPTION OF DRAWINGS

The above and other aspects, features, and advantages of certain embodiments of the disclosure will be more apparent from the following description taken in conjunction with the accompanying drawings, in which:

FIG. 5 is a table illustrating a degree of deformation of a roller according to a non-use time of a dryer according to an embodiment of the disclosure;

FIG. 8 is a table illustrating a pulley ratio of a motor and a drum of a dryer used in an experiment according to an embodiment of the disclosure;

FIG. 9 is a table illustrating a noise-free condition according to a degree of deformation of a shape of a roller according to an embodiment of the disclosure;

FIG. 10 is a table illustrating a time taken until rotational initial noise disappears according to a degree of deformation of a roller according to an embodiment of the disclosure;

FIG. 11 is a table illustrating a number of rotations of a drum required until rotational initial noise disappears according to a degree of deformation of a roller according to an embodiment of the disclosure;

FIG. 13 is a table illustrating an optimal rotation velocity of a motor according to an ambient temperature and a non-use time according to an embodiment of the disclosure;

FIG. 14 is a table illustrating an optimal rotation time of a motor according to an ambient temperature and a non-use time according to an embodiment of the disclosure;

Throughout the drawings, it should be noted that like reference numbers are used to depict the same or similar elements, features, and structures.

MODES OF THE DISCLOSURE

Figure 1:
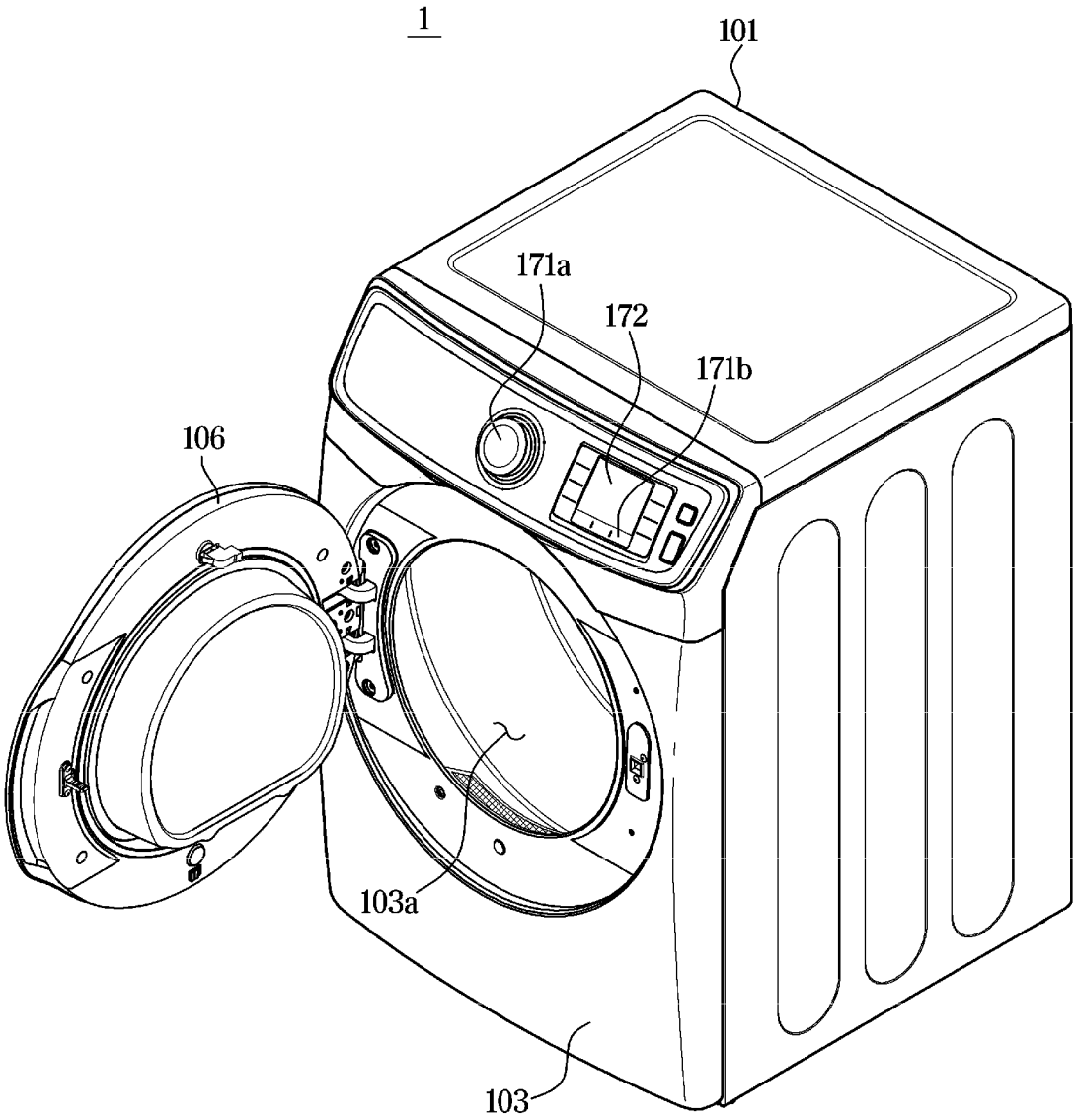
FIG. 1 is an external view illustrating a dryer according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Terms "comprise," "is provided with," "have," and the like are used herein to specify the presence of stated features, numerals, steps, operations, components, parts or combinations thereof but do not preclude the presence or addition of one or more other features, numerals, steps, operations, components, parts, or combinations thereof.

Further, terms, such as "unit," "portion," "block," "member," "module" may refer to a unit of processing at least one function or operation. For example, these terms may refer to a hardware component, such as a field-programmable gate array (FPGA)/an application-specific integrated circuit (ASIC), a software component, or at least one cycle processed by a processor.

In addition, the ordinal numbers, such as "first ~" and "second ~" used in front of the components described in the specification are only used to distinguish the components from each other without having other meanings, such as the order of connection and use between the components, priority, or the like.

A reference numeral attached in each of operations is used to identify each of the operations, and this reference numeral does not describe the order of the operations, and the operations may be performed differently from the described order unless clearly specified in the context.

As used herein, expressions, such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

Hereinafter, an embodiment of a dryer according to an aspect and a method of controlling the same will be described with reference to the accompanying drawings.

Figure 2:
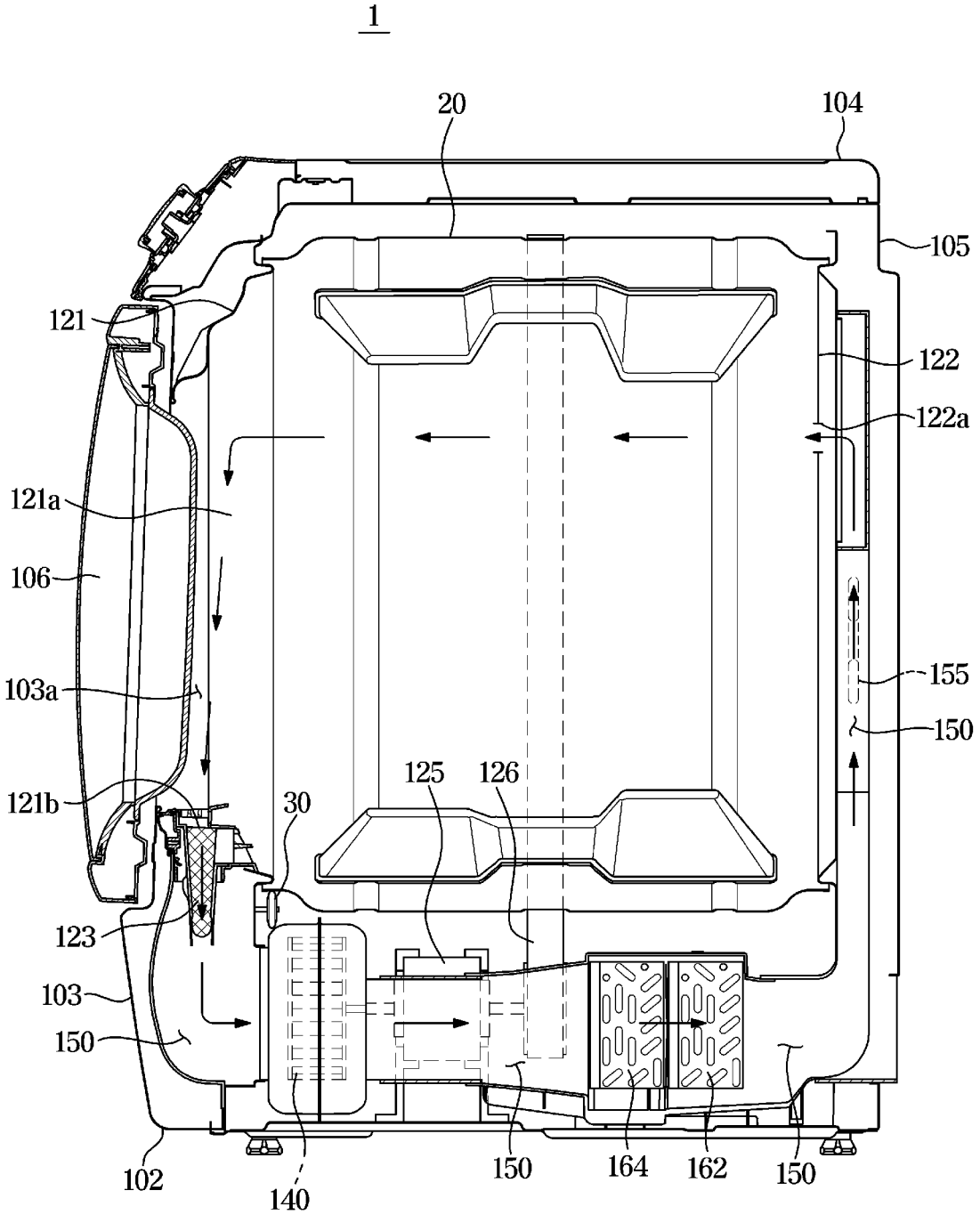
FIG. 2 is a side sectional view illustrating a dryer according to an embodiment of the disclosure.

FIG. 1 is an external view illustrating a dryer according to an embodiment of the disclosure, and FIG. 2 is a side sectional view illustrating a dryer according to an embodiment of the disclosure.

Referring to FIGS. 1 and 2 together, a dryer 1 according to an embodiment includes a cabinet 101 accommodating components of the dryer 1 and a drum 20 rotatably installed in the cabinet 101. Laundry, for which drying is to be performed, may be accommodated in the drum 20.

The cabinet 101 may include a base plate 102, a front cover 103, a top cover 104, and a side/rear cover 105.

The front cover 103 may be provided with an opening 103*a*, and the opening 103*a* may be opened and closed by a door 106 rotatably installed on the front cover 103. The drum 20 provided in a cylindrical shape with an open front may also be opened and closed by the door 106.

The front cover 103 may be provided on an upper portion thereof with input devices 171*a* and 171*b* for receiving a user command and a display 172 for displaying various types of information related to the operation of the dryer 1 or displaying a screen that guides user input.

The input devices 171*a* and 171*b* may be provided in the form of a jog shuttle or a dial such that the user may input a command by holding and turning, or pressing the input device 171*a*, or may be provided in the form of a touch pad or button such that the user may input a command by touching or pressing the input device 171*b*.

The display 172 may be implemented by various display panels, such as a liquid crystal display (LCD), a light emitting diode (LED), an organic LED (OLED), a quantum dot LED (QLED), and the like, and may be implemented as a touch screen having a touch pad formed on a front side thereof.

A front frame 121 having a laundry inlet 121*a* may be disposed on the front side of the drum 20, and laundry may be loaded into the drum 20 through the laundry inlet 121*a*. In addition, the rear side of the drum 20 may be closed by a rear frame 122 provided with an inlet 122*a* through which hot dry air is introduced.

The front frame 121 may be provided with an outlet 121*b* through which air used to dry laundry is discharged, and a filter 123 for collecting foreign substances generated from the laundry may be installed in the outlet 121*b*.

In addition, at least one lifter may be formed in a protrusion manner on an inner wall of the drum 20 to assist in tumbling of laundry.

The drum 20 may be rotated by power provided from a drum motor 125. The drum 20 may be connected to the drum motor 125 by a belt 126, and the belt 126 may transmit power provided from the drum motor 125 to the drum 20.

The drum 20 may be disposed such that the axis of rotation is parallel to the ground, and the axis of rotation of the drum 20 may be mounted on the rear frame 122.

As for methods of drying laundry by the dryer 1, a heater type is configured in a way to supply air heated by a heater to the inside of a drum to dry laundry, and a heat pump type is configured to remove moisture from laundry to dry the laundry. In the embodiment of the disclosure, a case in which the dryer 1 dries laundry by a heat pump method will be described as an example.

In addition, as for methods of processing high-temperature and high-humidity air that has passed through the drum 20, an air-vent type is configured in a way to discharge high-temperature and high-humidity air to the outside of the dryer 1, and a condensing type is configured in a way to remove moisture from high-temperature and high-humidity air and then circulate the air back into the drum 20. In the embodiment of the disclosure, a case in which the dryer 1 employs a condensing method will be described as an example.

The dryer 1 may include a fan 140 circulating air inside the drum 20. The fan 140 may suction air from inside the drum 20 and discharge the air through a duct 150. By the operation of the fan 140, air inside the drum 20 may circulate between the drum 20 and the duct 150.

A heat pump may be provided on the duct 150 through which air inside the drum 20 may circulate. The heat pump may include a compressor (not shown), a condenser 162, an evaporator 164, and an expander (not shown).

The compressor may compress a gaseous refrigerant into a high-temperature and high-pressure refrigerant, and discharge the compressed high-temperature and high-pressure gaseous refrigerant. For example, the compressor may compress the refrigerant through a reciprocating motion of a piston or a rotation motion of a rotary wheel. The discharged refrigerant is delivered to the condenser 162.

The condenser 162 may condense the compressed gaseous refrigerant into a liquid while discharging heat to surroundings. The condenser 162 may be provided on the duct 150, and the heat generated in the process of condensing the refrigerant may allow air to be heated. The heated air may be supplied to the drum 20. The liquid refrigerant condensed in the condenser 162 may be delivered to an expander (not shown).

The expander may expand the high-temperature and high-pressure liquid refrigerant condensed in the condenser 162 into a low-pressure liquid refrigerant. Specifically, the expander may include a capillary tube and an electronic expansion valve, of which the opening degree may be varied by an electric signal, for adjusting the pressure of the liquid refrigerant.

The evaporator 164 may evaporate the liquid refrigerant expanded in the expander. As a result, the evaporator may return the low-temperature and low-pressure gaseous refrigerant to the compressor.

The evaporator 164 may absorb heat from the surroundings through an evaporation process in which a low-pressure liquid refrigerant is converted into a gaseous refrigerant. The evaporator 164 may be provided on the duct 150 so that air passing through the evaporator 164 may be cooled in the evaporation process.

The evaporator 164 may cause the ambient air to be cooled, and when the temperature of the ambient air becomes lower than the dew point, the air around the evaporator 164 may be condensed. The water condensed in the evaporator 164 may be collected by a water trap provided at a lower side of the evaporator 164. The water collected in the water trap may be moved to a separate storage or drained to the outside of the dryer 1.

Due to the condensation occurring around the evaporator 164, the absolute humidity of air passing through the evaporator 164 may be lowered. In other words, the amount of water vapor included in the air passing through the evaporator 164 may decrease. By using the condensation occurring around the evaporator 164, the dryer 1 may reduce the amount of water vapor contained in the air inside the drum 20 and dry laundry.

The evaporator 164 may be located upstream of the condenser 162 based on a flow of air by the fan 140. The air circulating by the fan 140 may be dried (water vapor is condensed) by the evaporator 164 while passing through the evaporator 164, and then heated by the condenser 162 while passing through the condenser 162.

Meanwhile, the duct 150 may be provided with a heater 155 for heating air while assisting the condenser 162. The heater 155 may be located downstream of the condenser 162 based on a flow of air by the fan 140.

For example, air heated in the condenser 162 of the heat pump 160 may be additionally heated by the heater 155 such that the air in the duct 150 may be sufficiently heated.

By the operation of the heater 155 assisting the condenser 162, the internal temperature of the drum 20 may rise more rapidly, and the time required to dry laundry may be shortened.

Figure 3:
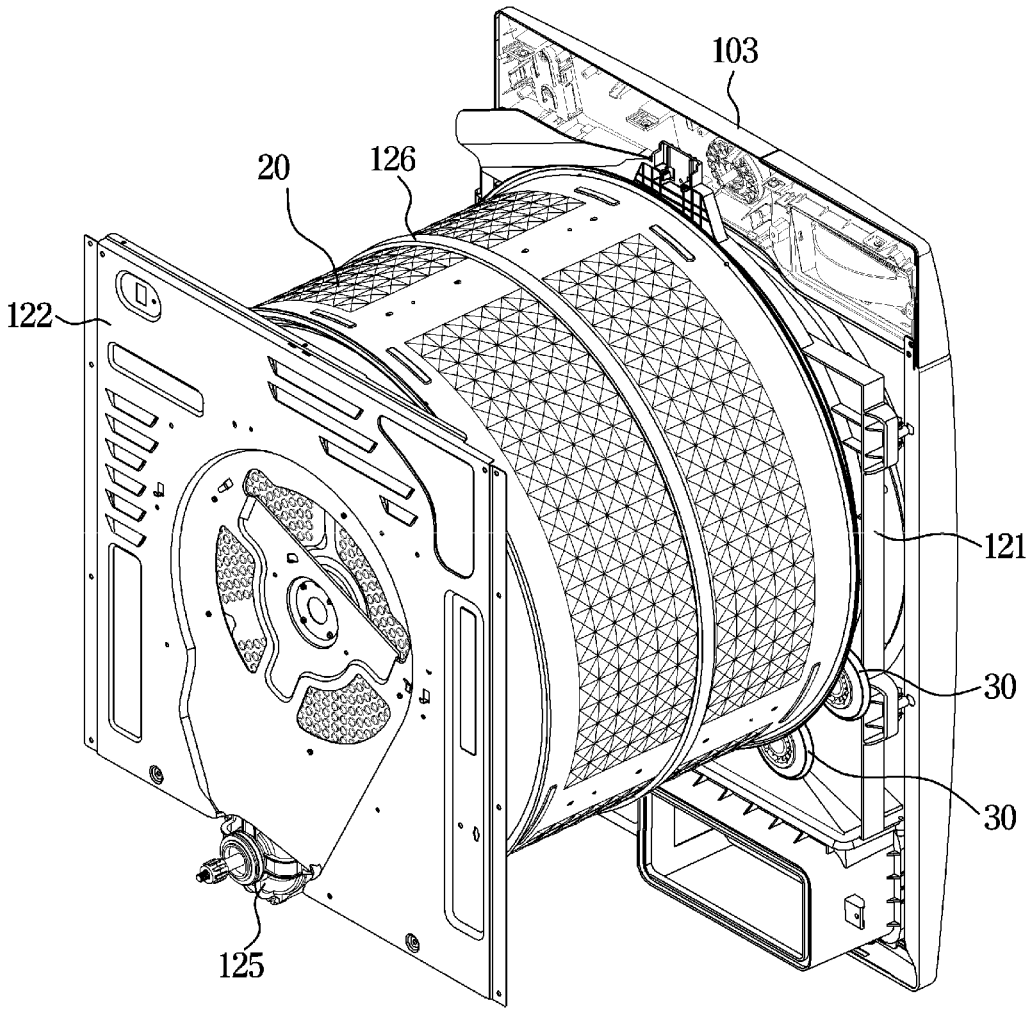
FIG. 3 is a perspective view illustrating a drum and some configurations of a dryer according to an embodiment of the disclosure.
Figure 4:
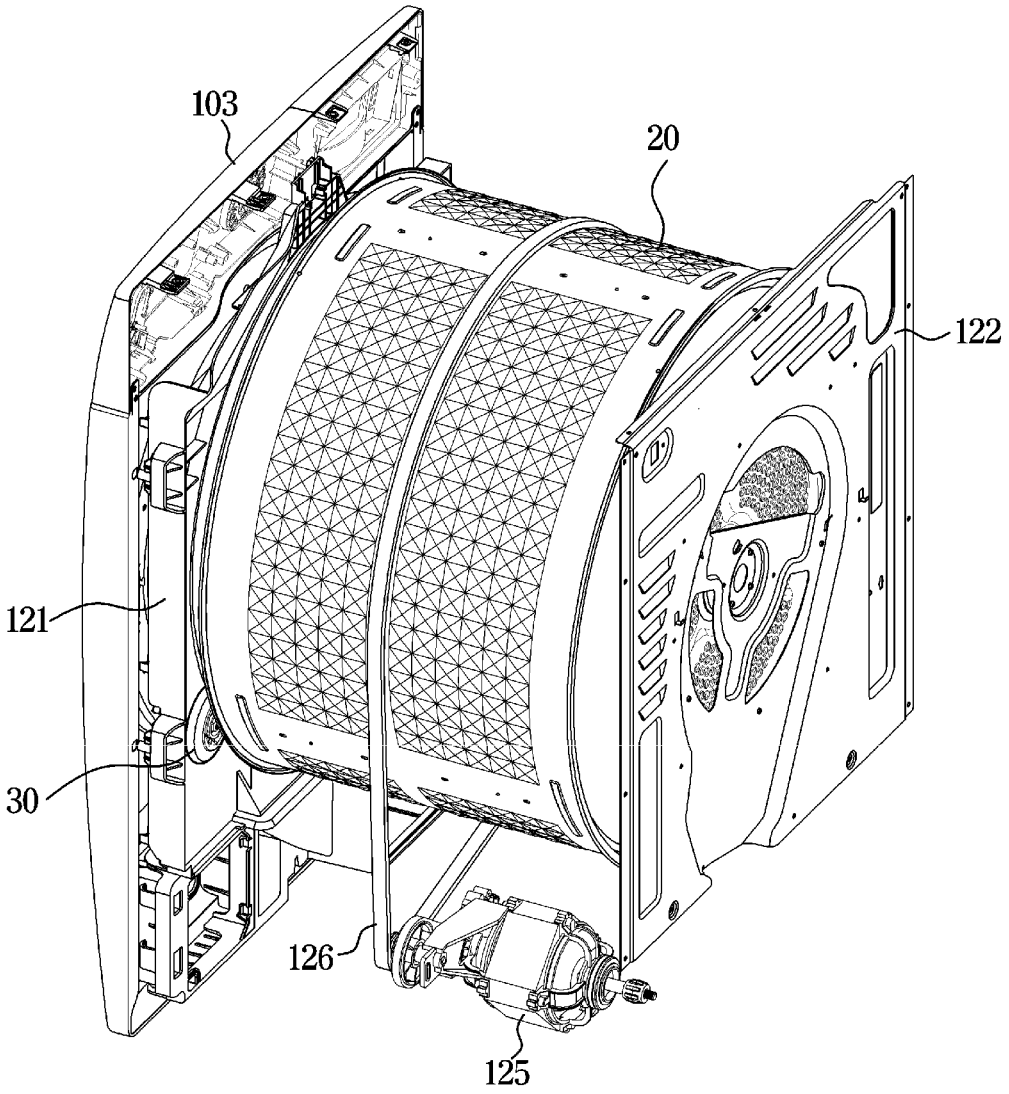
FIG. 4 is a perspective view illustrating a drum and some configurations of a dryer according to an embodiment of the disclosure.

FIG. 3 is a perspective view illustrating a drum and some configurations of a dryer according to an embodiment of the disclosure. FIG. 4 is a perspective view illustrating a drum and some configurations of a dryer according to an embodiment of the disclosure.

Referring to FIGS. 3 and 4 together, at least one roller 30 supporting the drum 20 may be mounted on the front frame 121. Specifically, the at least one roller may be provided at a position in contact with the drum 20 in a lower portion of the drum 20. Accordingly, in a state in which the drum 20 is stopped, at least one roller 30 may support at least part of the weight of the drum 20.

While the drum 20 is being rotated, the at least one roller 30 may rotate together with the drum 20. In this case, the at least one roller 30 may rotate in a direction opposite to the rotating direction of the drum 20 to efficiently assist the rotation of the drum 20.

A surface of the at least one roller 30 that is in contact with the drum 20 may be formed of a rubber material so that noise generated by a contact between the drum 20 and the at least one roller 30 may be minimized.

Referring to FIGS. 3 and 4, a case in which the at least one roller 30 is provided only at a position in contact with the drum 20 in the lower portion of the drum is illustrated, but embodiments of the dryer 1 are not limited thereto. According to a design change by a person skilled in the art, the at least one roller 30 may be provided even at a position in contact with the drum 20 in an upper portion of the drum 20 so that rotation of the drum 20 may be smoothly performed.

In addition, in FIGS. 3 and 4, a case in which the at least one roller 30 is provided only on the front frame 121 is illustrated, but embodiments of the dryer 1 are not limited thereto. According to a design change by a person skilled in the art, the at least one roller 30 may be provided on the rear frame 122 to support the drum 20 on the front and rear of the drum 20 while assisting the rotation of the drum 20.

Figure 6:
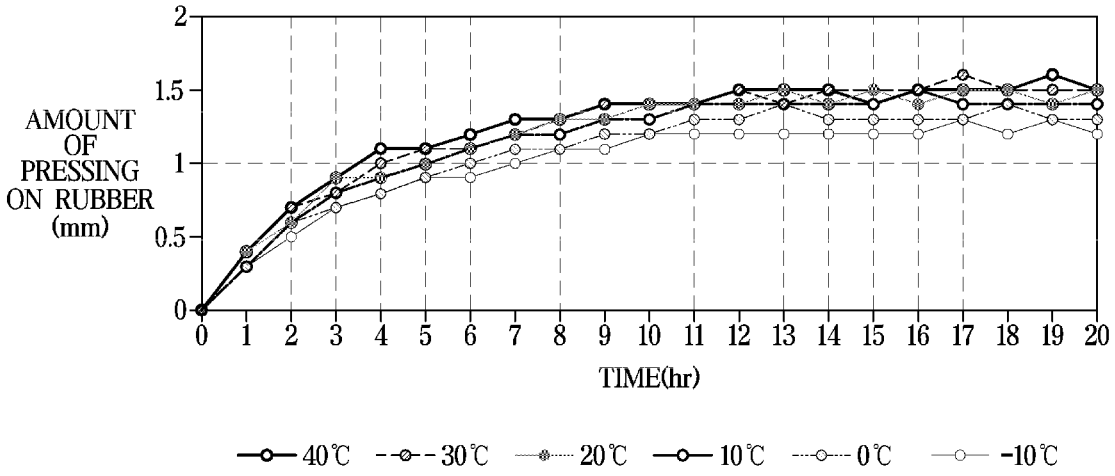
FIG. 6 is a graph illustrating a degree of deformation of a roller according to a non-use time of a dryer according to an embodiment of the disclosure.

FIG. 5 is a table illustrating a degree of deformation of a roller according to a non-use time of a dryer according to an embodiment of the disclosure. FIG. 6 is a graph illustrating a degree of deformation of a roller according to a non-use time of a dryer according to an embodiment of the disclosure.

As described above, while the drum 20 is not rotating, the at least one roller 30, in particular, the at least one roller 30 provided at a position in contact with the drum 20 in the lower portion of the drum 20 will support at least part of the weight of the In this case, pressure may be applied to the at least one roller 30, and the at least one roller 30, of which the surface is formed of a rubber material, may be subject deformation, such as compression, twist, and the like by the pressure applied in a stationary state of the drum 20.

The degree to which the surface of the rubber roller 30 is pressed by the drum 20 depending on the non-use time of the dryer 1 was measured at different ambient temperatures, and the measurement results are shown in the table of FIG. 5 and the graph of FIG. 6.

Here, the ambient temperature may represent the temperature of the surrounding of the at least one roller 30. For example, the ambient temperature may represent the temperature of a space in which the dryer 1 is located, or may be a temperature measured by a temperature sensor provided at a surrounding of the roller inside the dryer 1.

The ambient temperature may vary depending on the region in which the dryer 1 is used, or may vary depending on the season even in the same region. Due to the nature of the rubber material, the degree of deformation of the roller 30 may vary depending on the ambient temperature even when the same pressure is applied.

Referring to FIGS. 5 and 6, it can be seen that as the non-use time of the dryer 1 increases, the amount by which the surface of the roller 30 is pressed, that is, the degree of deformation of the roller 30 increases. In addition, it can be seen that the degree of deformation of the roller 30 increases as the ambient temperature increases.

However, the degree of deformation of the roller 30 does not continue to increase in proportion to the increasing non-use time of the dryer 1, and as shown in FIGS. 5 and 6, the degree of deformation of the roller 30 becomes constant when a certain period of time elapses.

The shape of the roller 30 deformed as described above may be restored to the original state when the stopped drum 20 rotates again. For example, the deformation of the roller 30 due to the weight of the stopped drum 20 is a short-period deformation.

However, when the drum 20 rotates in a state in which the roller 30 is deformed, friction between the roller 30 and the drum 20 may generate rotational initial noise.

The dryer 1 according to an embodiment of the disclosure and the method of controlling the same may perform a noise reduction cycle of reducing noise generated in the early stage of rotation of a drum 20 due to the deformed shape of the roller 30 before a main cycle of the dryer 1 starts, thereby reducing inconvenience in use of the dryer 1 due to noise. Hereinafter, specific embodiments related to the noise reduction cycle will be described.

Figure 7:
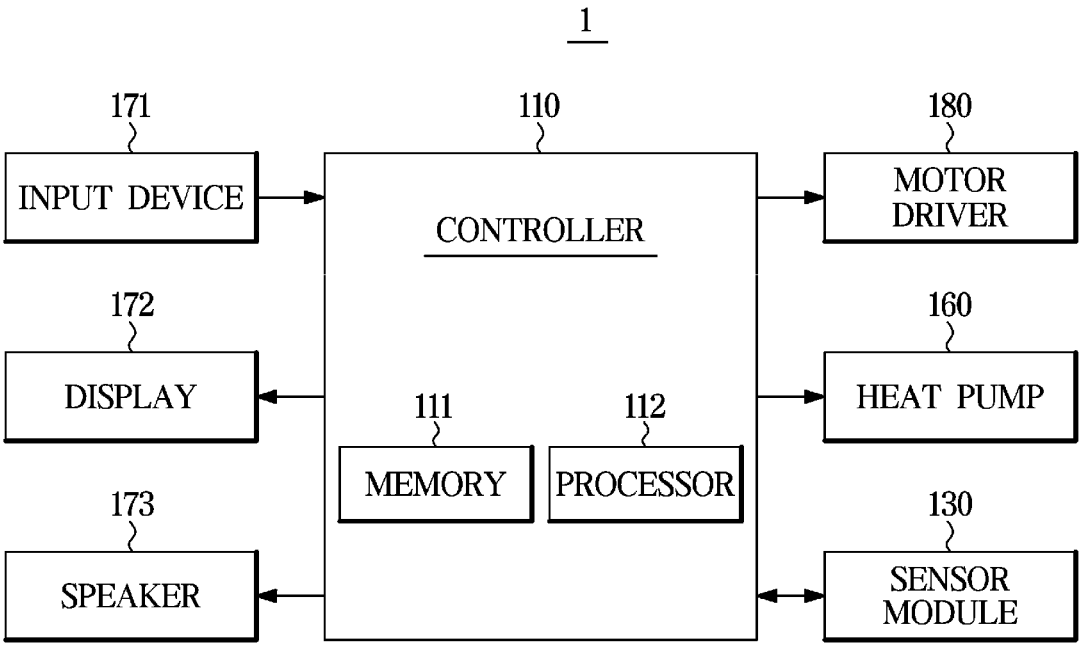
FIG. 7 is a block diagram illustrating an operation of a dryer according to an embodiment of the disclosure.

FIG. 7 is a block diagram illustrating an operation of a dryer according to an embodiment of the disclosure.

Referring to FIG. 7, the dryer 1 according to an embodiment may include a heat pump 160, an input device 171, a display 172, a speaker 173, and a motor driver 180 described above, and may further include a controller 110 and a sensor module 130.

In the following description, the same configurations as those described above will be omitted.

The sensor module 130 may include at least one sensor that measures various types of data required for controlling the dryer 1. For example, the sensor module 130 may include a humidity sensor for measuring the humidity of laundry loaded into the drum 20, a temperature sensor for measuring the ambient temperature of the dryer 1 or the temperature inside the dryer 1 (e.g., the temperature of the surrounding of the roller 30).

The controller 110 may control the overall operation of the dryer 1. The controller 110 may control components of the dryer 1 based on a user input received by the input device 171 or data measured by the sensor module 130.

The controller 110 may include at least one memory 111 storing a program for performing operations described below and at least one processor 112 executing the stored program. For example, the controller 110 may be implemented as a microcontroller unit (MCU).

A cycle selectable by the user through the input device 171 may include a drying cycle for drying laundry and an additional cycle. For example, the additional cycle may include a dusting cycle, a functional clothes care cycle for padding or outdoor clothing, and the like.

In response to receiving a user input for selecting a drying cycle through the input device 171, the controller 110 may determine a rotation velocity and a rotation time of the drum motor 125 for rotating the drum 20, and control the motor driver 180 according to the determined rotation velocity and the determined rotation time to rotate the drum motor 125.

The rotation velocity and the rotation time of the drum motor 125 for the drying cycle may be determined based on factors, such as the weight of a laundry to be dried, the humidity of the laundry, and the type of the laundry.

The humidity of the laundry may be measured by the above described humidity sensor, and information about the type of the laundry may be input by a user through the input device 171. For example, the user may input information about the type of the laundry, such as blankets, towels, delicate clothes, wool, shirts, and denim, through the input device 171. Alternatively, the sensor module 130 may detect the type of laundry.

The weight of the laundry may be determined by at least one of various methods for detecting the weight. For example, the controller 110 may determine the weight of the laundry by performing a weight sensing cycle before starting a drying cycle. In the weight sensing cycle, the controller 110 may rotate the drum 20 at a high velocity for a predetermined period of time and determine the weight of the laundry based on a load applied to the drum motor 125 during the rotation of the drum 20.

As described above, the shape of the roller 30 may be deformed due to the weight of the drum 20 during a non-use time of the dryer 1, and when the drum 20 rotates in a state in which the shape of the roller 30 is deformed, noise may occur due to friction between the roller 30 and the drum 20 having an irregular shape.

Therefore, the controller 110 may perform a noise reduction cycle for reducing noise caused by rotation of the drum 20 before starting a cycle including rotations of the drum 20.

For example, the cycle including rotations of the drum 20 may include a drying cycle for drying laundry and a dusting cycle for dusting blankets or carpets. In the embodiments described below, for the sake of convenience of description, a cycle including rotations of the drum 20 will be referred to as a rotation cycle.

As described above, the deformation of the roller 30 caused by the weight of the drum 20 is temporary, and when the drum 20 rotates again while in contact with the drum 20, the deformed shape of the roller 30 returns to the original shape.

Therefore, the controller 110 may rotate the drum 20 at an appropriate velocity for an appropriate time to perform the noise reduction cycle, and a rotation velocity and a rotation time of the drum motor 125 for rotating the drum 20 at the appropriate velocity for the appropriate time may be determined based on the non-use time of the dryer 1. In the embodiment of the disclosure, the non-use time of the dryer 1 may indicate the time for which the drum 20 remains stopped.

For example, the rotation velocity and the rotation time of the drum motor 125 corresponding to the non-use time of the dryer 1 may be determined based on data obtained through experiments. The rotation velocity and the rotation time of the drum motor 125 corresponding to the non-use time of the dryer 1 refer to a rotation velocity and a rotation time of the drum motor 125 that allow the roller 30 to restore the original shape without generating noise caused by rotations of the drum 20 in a process of rotating the drum 20 after the dryer 1 has not been used for a time corresponding to the non-use time. In an embodiment to be described below, the rotation velocity and the rotation time of the drum motor 125 may be referred to as a first rotation velocity and a first rotation time, respectively.

Data used to determine the first rotation velocity and the first rotation time of the drum motor 125 may be obtained through experiments in a manufacturing process of the dryer 1. The data may be obtained for each individual dryer 1, for each model of the dryer 1, or for each size or weight of the drum 20.

A criterion for obtaining the data may not be limited, and the data may be shared by a plurality of dryers 1 as long as it is data for a dryer 1 that exhibits the same or similar deformation characteristics and restoration characteristics of the roller 30.

Hereinafter, an experimental example conducted to provide a criterion for determining the first rotation velocity and the first rotation time of the drum motor 125 will be described.

FIG. 8 is a table illustrating a pulley ratio of a motor and a drum of a dryer used in an experiment according to an embodiment of the disclosure, and FIG. 9 is a table illustrating a noise-free condition according to the degree of deformation of a roller according to an embodiment of the disclosure.

Referring to FIG. 8, in the dryer 1 used in the experiment, the drum 20 has a rotation velocity of 8.8 RPM at a rotation velocity of 400 RPM of the drum motor 125, has a rotation velocity of 17.7 RPM at a rotation velocity of 800 RPM of the drum motor 125, and has a rotation velocity of 26.5 RPM at a rotation velocity of 1200 RPM of the drum motor 125. For example, the pulley ratio is 45.2.

Referring to FIG. 9, a result measuring the maximum RPM of the drum motor 125, at which noise is not generated, by varying the degree of deformation of the roller 30 (the amounts of pressing on the rubber surface) for five dryers 1 of the same model is shown. In the table of FIG. 9, each of the dryers 1 is indicated as SET 1, SET 2, SET 3, SET 4, and SET 5.

Rotational initial noise generated in the early stage of rotation when the drum 20 rotates in a state in which the roller 30 is deformed increases in proportion to the increasing rotation velocity of the drum motor 125. Therefore, the maximum RPM of the drum motor 125, at which noise is not generated, was measured for each degree of deformation of the roller 30 through experiments, and the results are shown in the table of FIG. 9.

Referring to FIG. 9, when the degree of pressing on the rubber surface of the roller 30 is 0.2 mm, the maximum value, among the maximum RPMs at which rotation rotational initial noise is not generated measured for the five dryers 1, is 1550 RPM, and when the degree of pressing on the rubber surface of the roller 30 is 0.3 mm, the maximum value is 1450 RPM, and when the degree of pressing on the rubber surface of the roller 30 is 0.4 mm, the maximum value is 1400 RPM.

It can be seen that as the degree of deformation of the roller 30 increases, the maximum RPM of the drum motor 125, at which noise is not generated in the early stage of rotation, decreases, and when the degree of pressing on the rubber surface of the roller 30 is 1.5 mm, the maximum value, among the maximum RPMs at which rotational initial noise is not generated has a low level of 850 RPM.

Figure 12:
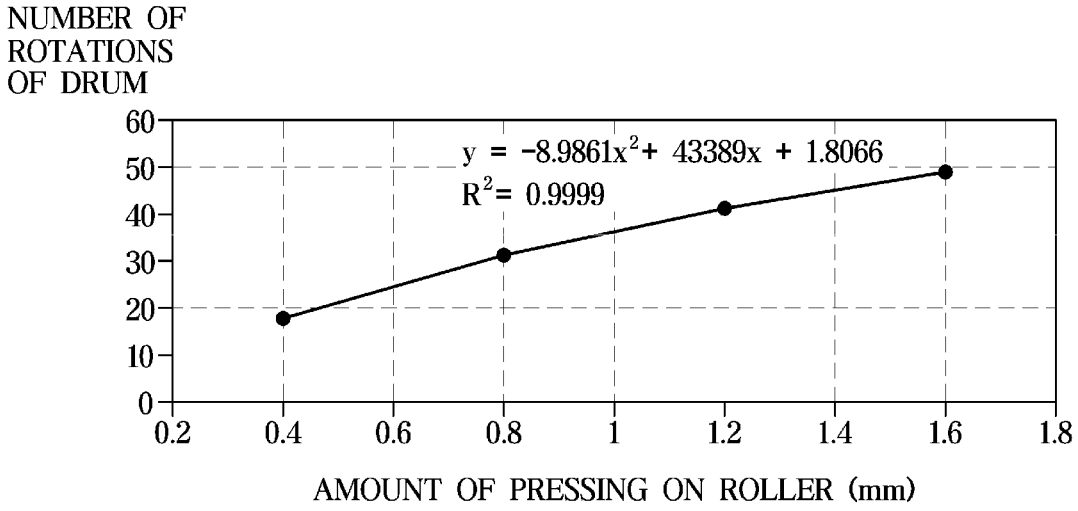
FIG. 12 is a graph illustrating a number of rotations of a drum required until rotational initial noise disappears according to a degree of deformation of a roller according to an embodiment of the disclosure.

FIG. 10 is a table illustrating a time taken until rotational initial noise disappears according to the degree of deformation of a roller according to an embodiment of the disclosure, and FIG. 11 is a table illustrating a number of rotations of a drum required until rotational initial noise disappears according to the degree of deformation of a roller according to an embodiment of the disclosure, and FIG. 12 is a graph illustrating a number of rotations of a drum required until rotational initial noise disappears according to the degree of deformation of a roller according to an embodiment of the disclosure.

Referring to FIG. 10, a result measuring a time taken until rotational initial noise does not occur by varying the amount of pressing on the roller 30 to 0.4 mm, 0.8 mm, 1.2 mm, and 1.6 mm, and the rotation velocity of the drum motor 125 to 1600 RPM, 2000 RPM, and 2400 RPM is shown.

Referring to FIG. 10, the times taken until rotational initial noise does not occur differ for each rotation velocity of the drum motor 125 and each amount of pressing on the roller 30.

The times shown in FIG. 10 were applied to Equation 1 below to calculate the number of rotations $A_{drum}$ of the drum 20 required for the rotational initial noise to disappear.

$$A_{drum}=(R_M*T)/(P*60) \quad \text{Equation 1}$$

Here, $R_M$ denotes the rotation velocity (a revolution per minute: an RPM) of the drum motor 125, T denotes the time s taken until the rotational initial noise does not occur, and P denotes the pulley ratio of the drum motor 125 and the drum 20.

The results calculated by Equation 1 are shown in the table of FIG. 11 and in the graph of FIG. 12. Referring to FIG. 11, it can be seen that when the amount of pressing on the roller 30 is 0.4 mm, the number of rotations of the drum 20 required to eliminate the rotational initial noise is included in a range of 17 to 19 (the average: 18), regardless of whether the rotation velocity of the drum motor 125 is 1600 RPM, 2000 RPM, or 2400 RPM, with a very small fluctuation.

In addition, when the amount of pressing of the roller 30 is 0.8 mm, the number of rotations on the drum 20 required to eliminate the rotational initial noise is included in a range of from 31 to 32 (the average: 31), regardless of whether the rotation velocity of the drum motor 125 is 1600 RPM, 2000 RPM, or 2400 RPM, with a very small fluctuation.

In addition, when the amount of pressing on the roller 30 is 1.2 mm, the number of rotations on the drum 20 required to eliminate the rotational initial noise is included in a range of from 40 to 42 (the average: 41), regardless of whether the rotation velocity of the drum motor 125 is 1600 RPM, 2000 RPM, or 2400 RPM, with a very small fluctuation.

In addition, when the amount of pressing of the roller 30 is 1.6 mm, the number of rotations on the drum 20 required to eliminate the rotational initial noise is included in a range of from 47 to 50 (the average: 49), regardless of whether the rotation velocity of the drum motor 125 is 1600 RPM, 2000 RPM, or 2400 RPM, with a very small fluctuation.

The results of FIG. 11 indicate that the number of rotations of the drum 20 required until the rotational initial noise disappears is almost the same when the degree of deformation of the roller 30 is the same.

For example, it can be seen that, regardless of the rotation velocity of the drum 20 or the rotation velocity of the drum motor 125, the shape of the roller 30 returns to the original state only by rotating the roller 30 by a predetermined number that is determined according to the degree of deformation of the roller 30.

The average values shown in the table of FIG. 11 may be plotted on a graph as shown in FIG. 12. Referring to FIG. 12 together, it can be seen that the number of rotations of the drum 20 required to restore the shape of the roller 30 increases as the degree of deformation of the roller 30 increases.

FIG. 13 is a table illustrating an optimal rotation velocity of a motor according to an ambient temperature and a non-use time according to an embodiment of the disclosure, and FIG. 14 is a table illustrating an optimal rotation time of a motor according to an ambient temperature and a non-use time according to an embodiment of the disclosure.

When the data (FIG. 5) showing the degree of deformation of the roller 30 according to the ambient temperature and the non-use time is combined with the data (FIG. 9) showing the rotation velocity of the drum motor 125, at which rotational initial noise does not occur, according to the degree of deformation of the roller 30, an optimal velocity of the motor according to the ambient temperature and the non-use time may be obtained, and the results are shown in FIG. 13.

When data (FIG. 5) showing the degree of deformation of the roller 30 according to the ambient temperature and the non-use time is combined with the data (FIG. 11) showing the rotation time of the drum motor 125, in which rotational initial noise does not occur, according to the degree of deformation of the roller 30, the optimal velocity of the motor according to the ambient temperature and the non-use time, and the pulley ratio of the drum motor 125 and the drum 20, an optimal operating time (a rotation time) of the motor according to the ambient temperature and the non-use time may be obtained, and the results are shown in FIG. 14.

The controller 110 may store tables representing the optimal operating time of the motor according to the ambient temperature and the non-use time as shown in FIGS. 13 and 14, and determine the first rotation velocity and the first rotation time of the drum motor 125 based on the stored tables.

Alternatively, when a relational expression of the ambient temperature, the non-use time, and the optimal operating time of the motor is generated from the tables as shown in FIGS. 13 and 14, the generated relational expression may be stored, and the controller 110 may determine the first rotation velocity and the first rotation time the drum motor 125 based on the stored relational expression.

Alternatively, the controller 110 may store a deep learning model generated based on the data shown in FIGS. 13 and 14 and use the stored deep learning model to determine the first rotation velocity and the first rotation time of the drum motor 125.

Hereinafter, a process of the controller 110 determining the first rotation velocity and the first rotation time of the drum motor 125 based on the non-use time of the dryer 1 and the ambient temperature of the dryer 1 will be described in a method of controlling the dryer 1 according to an embodiment with reference to a flowchart.

Figure 15:
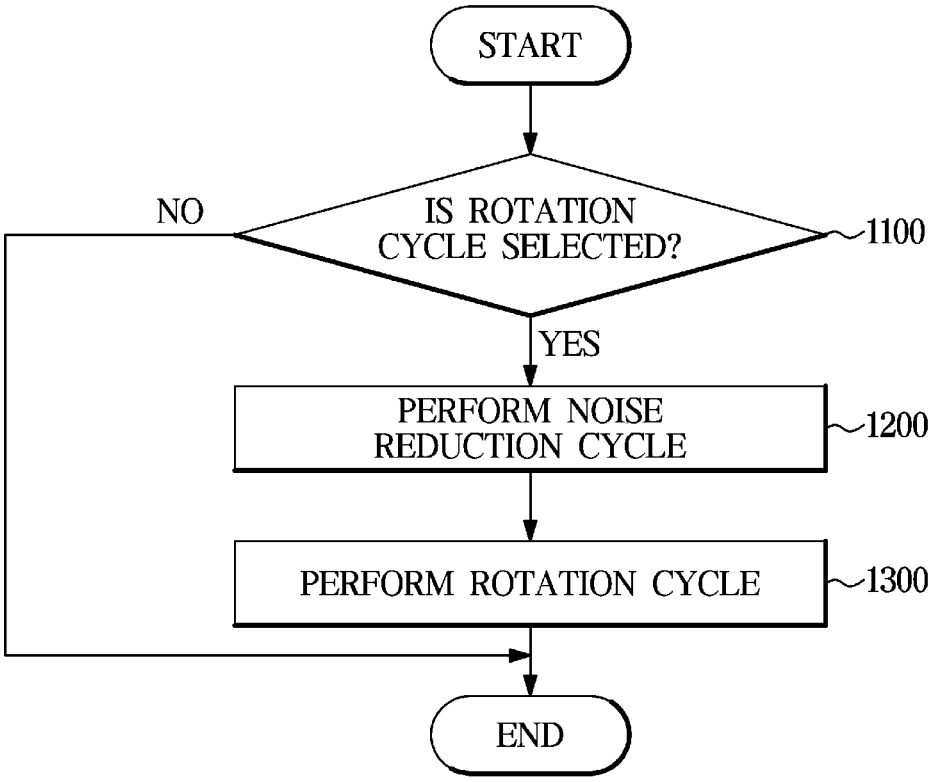
FIG. 15 is a flowchart illustrating a method of controlling a dryer according to an embodiment of the disclosure.
Figure 16:
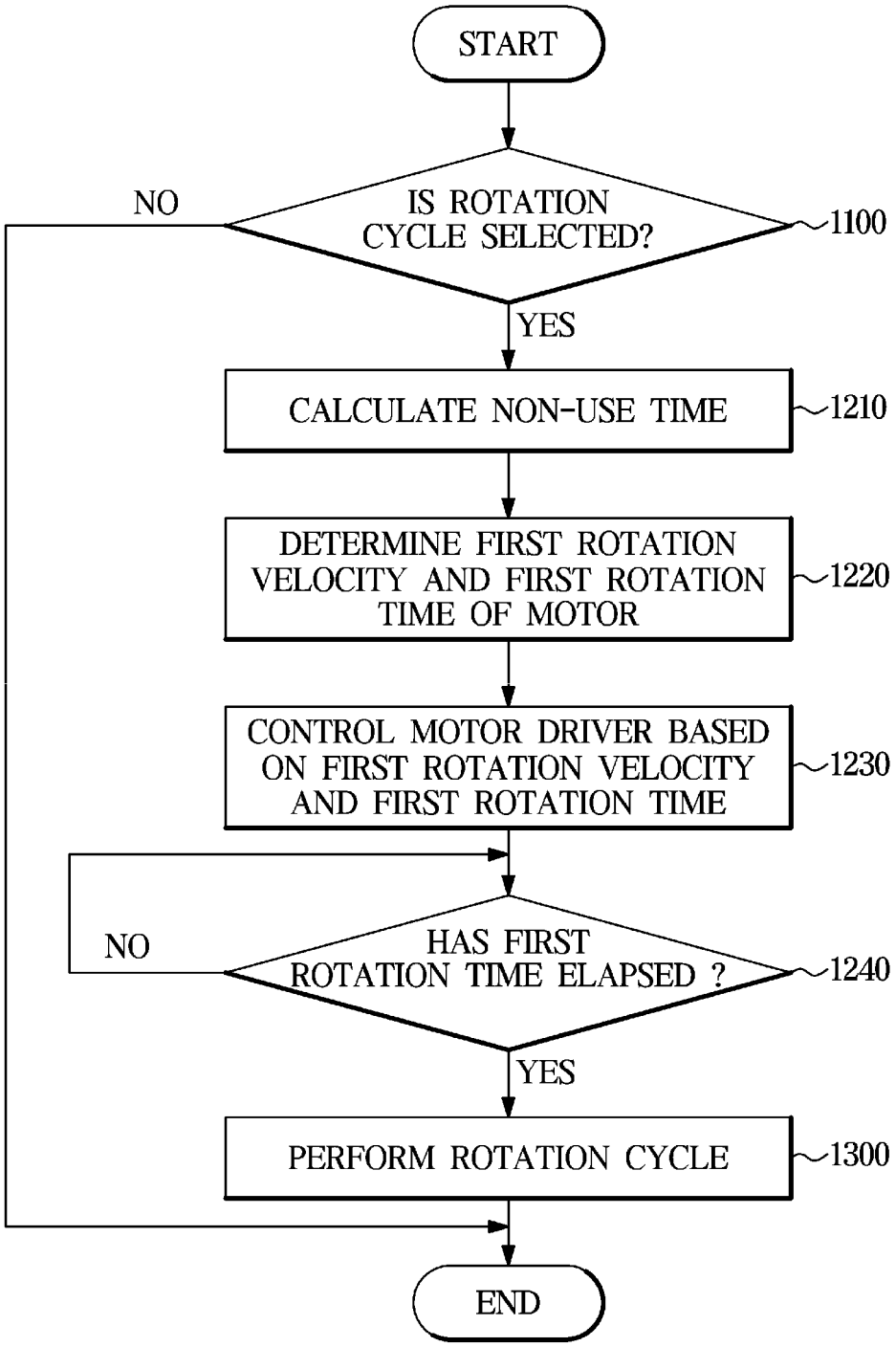
FIG. 16 is a flowchart a method of controlling a dryer, specifically illustrating a noise reduction cycle according to an embodiment of the disclosure.

FIG. 15 is a flowchart illustrating a method of controlling a dryer according to an embodiment of the disclosure, and FIG. 16 is a flowchart a method of controlling a dryer, specifically illustrating a noise reduction cycle according to an embodiment of the disclosure.

The method of controlling the dryer 1 according to the embodiment may be executed by the dryer 1 according to the above-described embodiment. Therefore, details of the dryer 1 described above may be applied to the method of controlling the dryer according to the embodiment unless stated otherwise, and details of the method of controlling the dryer described below may also be applied to the dryer 1 according to the embodiment unless stated otherwise.

In the flow charts of FIGS. 15 and 16, the dryer 1 is assumed as being at an On state.

Referring to FIG. 15, in response to a rotation cycle being selected by the user in operation 1100 YES, that is, in response to a user input for selecting a rotation cycle being received through the input device 171, the controller 110 may perform a noise reduction cycle for reducing noise caused by deformation of the roller in operation 1200, and upon the noise reduction cycle being completed, perform the selected rotation cycle in operation 1300. The rotation cycle may refer to a cycle including rotations of the drum 20, such as a drying cycle or a dusting function cycle.

As described above, the at least one roller 30 that supports the drum 20 and rotates together with the drum 20 during rotation of the drum 20 has a surface formed of a rubber material. Therefore, while the drum 20 is in a stationary state, the surface of the at least one roller 30 may be deformed by the pressure received by supporting the drum 20, and when the drum 20 rotates again in a state in which the at least one roller 30 is deformed, noise may occur due to friction between the drum 20 and the deformed roller 30.

Therefore, in the method of controlling the dryer according to the embodiment of the disclosure, a noise reduction cycle is performed before starting a rotation cycle including rotations of the drum 20, to restore the shape of the at least one roller 30 without generating noise.

Referring to FIG. 16, the controller 110 may calculate a non-use time of the dryer 1 to perform the noise reduction cycle in operation 1210.

The controller 110 may calculate the non-use time of the dryer 1 based on the time gap between a time at which the cycle ends last and a time at which the noise reduction cycle starts or a current time.

In the embodiment of the disclosure, the non-use time of the dryer 1 may refer to a non-rotation time of the drum 20, that is, a time for which the drum 20 stops. Therefore, the controller 110 may determine the non-use time of the dryer 1 based on the time gap between the time at which the rotation cycle ends last, that is, at which the rotation of the drum 20 ends last, and the time at which the noise reduction cycle starts or the current time.

The controller 110 may determine the first rotation velocity and the first rotation time of the motor based on the non-use time of the dryer 1 in operation 1220.

As described above, data regarding the optimal rotation velocity and the optimal rotation time of the motor according to the non-use time of the dryer 1 may be stored in the controller 110.

The optimal rotation velocity of the motor according to the non-use time of the dryer 1 may indicate the maximum RPM of the drum motor 125, at which rotational initial noise does not occur, when the drum 20, which has not been used for a time corresponding to the non-use time, is rotated again.

The optimal rotation time of the motor according to the non-use time of the dryer 1 may indicate the time required to restore the original shape of the roller 30 when the drum 20, which has not been used for a time corresponding to the non-use time, is rotated at the above-described optimal rotation velocity of the drum motor 125.

Meanwhile, the rotation velocity and the rotation time of the motor required to restore the shape of the roller 30 formed of rubber may be affected by the temperature of the surrounding of the roller 30. Accordingly, data on the optimal rotation velocity and the optimal rotation time of the motor according to the non-use time of the dryer 1 may be obtained and stored for each ambient temperature.

In this case, the controller 110 may, in response to a rotation cycle being selected, obtain data on the temperature of the surrounding of the roller 30 from the sensor module 130. The data measured by the sensor module 130 may be data obtained by measuring the temperature of a space in which the dryer 1 is located, or may be data measured by a temperature sensor provided at a surrounding of the roller 30 inside the dryer 1.

Alternatively, the controller 110 may obtain data on the temperature of the surrounding of the roller 30 from the outside. In this case, the dryer 1 may further include a communication module that communicates with an external device, may obtain temperature-related data from other home appliances in the house through the communication module, and may also obtain temperature-related data from an external server that provides weather information.

The controller 110 may determine the first rotation velocity and the first rotation time of the motor based on the ambient temperature of the roller 30 and the non-use time of the dryer 1.

The controller 110 may control the motor driver 180 based on the first rotation velocity and the first rotation time in operation 1230, to rotate the drum motor 125 at the first rotation velocity for the first rotation time.

Upon the first rotation time elapsing in operation 1240 YES, the controller 110 performs the rotation cycle selected by the user in operation 1300. Alternatively, the controller 110 may perform the rotation cycle when a predetermined time further elapses upon the first rotation time elapsing.

Meanwhile, the selected rotation cycle may be a drying cycle or a dusting cycle, and a weight sensing cycle for detecting the weight of a laundry may be performed before the rotation cycle in order to optimally perform the rotation cycle. For example, the weight sensing cycle may be performed by rotating the drum 20 at a predetermined velocity, and in this case, the velocity of rotating the drum 20 in the weight sensing cycle may be higher than the velocity of rotating the drum 20 in the noise reduction cycle.

Since the deformation of the roller 30 has been restored without generating noise by the noise reduction cycle, even when the weight sensing cycle is performed by rotating the drum 20 at a high velocity, the cycle may proceed without generating rotational initial noise.

The method of controlling the dryer described above may be stored in a recording medium in which instructions executable by a computer are stored. For example, instructions for performing the method of controlling the dryer may be stored in a recording medium.

The instructions may be stored in the form of program code and, when executed by a processor, may perform the operations of the disclosed embodiments.

The recording medium may be embodied as a computer-readable recording medium. Here, the recording medium is a non-transitory computer-readable medium that stores data non-temporarily.

The computer-readable recording medium includes all kinds of recording media in which instructions which may be decoded by a computer are stored, for example, a Read Only Memory (ROM), a Random Access Memory (RAM), a magnetic tape, a magnetic disk, a flash memory, an optical data storage device, and the like.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A dryer comprising:

a cabinet;

a drum rotatably disposed inside the cabinet;

at least one roller mounted on at least one surface inside of the cabinet to support the drum;

a motor configured to provide power to rotate the drum;

a motor driver configured to control the motor; and at least one processor configured to:

determine at least one of a first rotation velocity of the motor or a first rotation time of the motor based on a non-use time of the dryer, and control the motor driver based on the determined at least one of the first rotation velocity or the first rotation time of the motor.

2. The dryer of claim 1, wherein the at least one roller:

while the drum is stationary, deforms due to a pressure applied from the drum; and while the drum is rotating, restores from the deformation.

3. The dryer of claim 2, further comprising:

an input device, wherein the at least one processor is further configured to:

upon receiving a user input to select a rotation cycle including a rotation of the drum, perform a noise reduction cycle for reducing noise generated by the deformation of the at least one roller, and start the rotation cycle after performing the noise reduction cycle.

4. The dryer of claim 3, wherein the at least one processor is further configured to:

in a process of performing the noise reduction, determine the at least one of the first rotation velocity of the motor or the first rotation time of the motor based on the non-use time of the dryer, and control the motor driver based on the determined at least one of the first rotation velocity or the first rotation time of the motor.

5. The dryer of claim 3, wherein the at least one processor is further configured to determine the non-use time of the dryer based on a time gap between a time at which the rotation of the drum is ended last, and a start time of the rotation cycle or a current time.

6. The dryer of claim 3, wherein the at least one processor is further configured to determine a maximum revolution per minute (RPM) of the motor at which noise due to the rotation of the drum does not occur as the first rotational velocity of the motor.

7. The dryer of claim 6, wherein the at least one processor is further configured to determine the first rotation time of the motor based on the non-use time of the dryer.

8. The dryer of claim 7, wherein the first rotation time of the motor is determined based on a first number of rotations of the drum and the first rotation velocity of the motor corresponding to the non-use time of the dryer.

9. The dryer of claim 8, wherein the first number of rotations of the drum corresponds to a minimum number of rotations of the drum required to restore the deformation of the at least one roller by rotating the drum.

10. The dryer of claim 1, wherein the at least one processor is further configured to determine the at least one of the first rotation velocity of the motor or the first rotation time of the motor based on the non-use time of the dryer and an ambient temperature.

11. A method of controlling a dryer including a cabinet, a drum rotatably disposed inside the cabinet, at least one roller mounted on at least one surface inside of the cabinet to support the drum, a motor configured to provide power to rotate the drum, and a motor driver configured to control the motor, the method comprising:

determining at least one of a first rotation velocity of the motor or a first rotation time of the motor based on a non-use time of the dryer; and controlling the motor driver based on the determined at least one of the first rotation velocity or the first rotation time of the motor.

12. The method of claim 11, wherein the at least one roller:

while the drum is stationary, deforms due to a pressure applied from the drum; and while the drum is rotating, restores from the deformation.

13. The method of claim 12, further comprising:

upon receiving a user input to select a rotation cycle including a rotation of the drum, performing a noise reduction cycle for reducing noise generated by the deformation of the at least one roller; and starting the rotation cycle after performing the noise reduction cycle.

14. The method of claim 13, wherein the performing of the noise reduction includes:

determining the at least one of the first rotation velocity of the motor or the first rotation time of the motor based on the non-use time of the dryer; and controlling the motor driver based on the determined at least one of the first rotation velocity or the first rotation time of the motor.

15. The method of claim 13, wherein the determining of the at least one of the first rotation velocity of the motor or the first rotation time of the motor based on the non-use time of the dryer includes determining the non-use time of the dryer based on a time gap between a time at which the rotation of the drum is ended last, and a start time of the rotation cycle or a current time.

16. The method of claim 13, wherein the determining of the at least one of the first rotation velocity of the motor or the first rotation time of the motor based on the non-use time of the dryer includes determining a maximum revolution per minute (RPM) of the motor at which noise due to the rotation of the drum does not occur as the first rotational velocity of the motor.

17. The method of claim 16, wherein the determining of the at least one of the first rotation velocity of the motor or the first rotation time of the motor based on the non-use time of the dryer includes determining the first rotation time of the motor based on the non-use time of the dryer.

18. The method of claim 17, wherein the first rotation time of the motor is determined based on a first number of rotations of the drum and the first rotation velocity of the motor corresponding to the non-use time of the dryer.

19. The method of claim 18, wherein the first number of rotations of the drum corresponds to a minimum number of rotations of the drum required to restore the deformation of the at least one roller by rotating the drum.

20. The method of claim 19, wherein the determining of the at least one of the first rotation velocity of the motor or the first rotation time of the motor based on the non-use time of the dryer includes determining the at least one of the first rotation velocity of the motor or the first rotation time of the motor based on the non-use time of the dryer and an ambient temperature.

21. The method of claim 20, wherein the selected rotation cycle includes at least one of a drying cycle or a dusting cycle, and wherein a weight sensing cycle for detecting the weight of a laundry is performed before the rotation cycle in order to optimally perform the rotation cycle.

22. The method of claim 21, wherein the weight sensing cycle is performed by rotating the drum at a predetermined velocity, and wherein the velocity of rotating the drum in the weight sensing cycle is higher than the velocity of rotating the drum in the noise reduction cycle.

* * * * *